United States Patent [19]

Smith

[11] Patent Number: 4,667,448

[45] Date of Patent: May 26, 1987

[54] GUTTER SYSTEM AND METHOD OF MANUFACTURE

[76] Inventor: Clark K. Smith, 1004 Wedgewood La., Durham, N.C. 27713

[21] Appl. No.: 788,956

[22] Filed: Oct. 18, 1985

Related U.S. Application Data

[63] Continuation-in-part of Ser. No. 546,747, Oct. 28, 1983, Pat. No. 4,590,716.

[51] Int. Cl.[4] ..... E04D 13/06

[52] U.S. Cl. ..... 52/12; 52/11

[58] Field of Search ..... 52/11-16; 210/153, 155, 162, 247

[56] References Cited

U.S. PATENT DOCUMENTS

| | | | |
|---|---|---|---|
| 891,405 | 6/1908 | Cassens | 52/12 X |
| 2,674,961 | 4/1954 | Lake | 52/12 X |
| 2,784,687 | 3/1957 | Hovey | 52/11 |
| 2,847,949 | 8/1958 | Pond | 52/12 |
| 3,550,381 | 12/1970 | South | 52/11 X |
| 3,950,951 | 4/1976 | Zukauskas | 52/12 X |
| 4,435,925 | 3/1984 | Jefferys | 52/12 |
| 4,450,654 | 5/1984 | Clendenin | 52/12 |

FOREIGN PATENT DOCUMENTS

| | | | |
|---|---|---|---|
| 1948337 | 10/1970 | Fed. Rep. of Germany | 52/11 |

*Primary Examiner*—William F. Pate, III
*Assistant Examiner*—Richard E. Chilcot, Jr.
*Attorney, Agent, or Firm*—Leonard Bloom

[57] ABSTRACT

A gutter for the roof structure of a building has a plurality of vertically-extending slotted openings interspersed between a respective plurality of comb teeth for diverting the rain water off the roof and into the conduit by a capillary attraction of the water molecules, as the leaves, twigs and other foreign matter washes off the roof. The width of the slotted openings is relatively narrow and the comb teeth are relatively rigid, so that birds, vermin and small animals cannot enter into the conduit for nesting therein. As a result, clogging of the gutter is prevented; cleaning of the gutter is substantially obviated; and the gutter is substantially maintenance free and relatively unaffected by the formation of snow or ice on the roof. Moreover, the gutter is made economically from a single piece which is punched, bent and formed; and the gutter may be easily installed by homeowners, do-it-yourselfers, and semi-skilled craftsmen.

16 Claims, 20 Drawing Figures

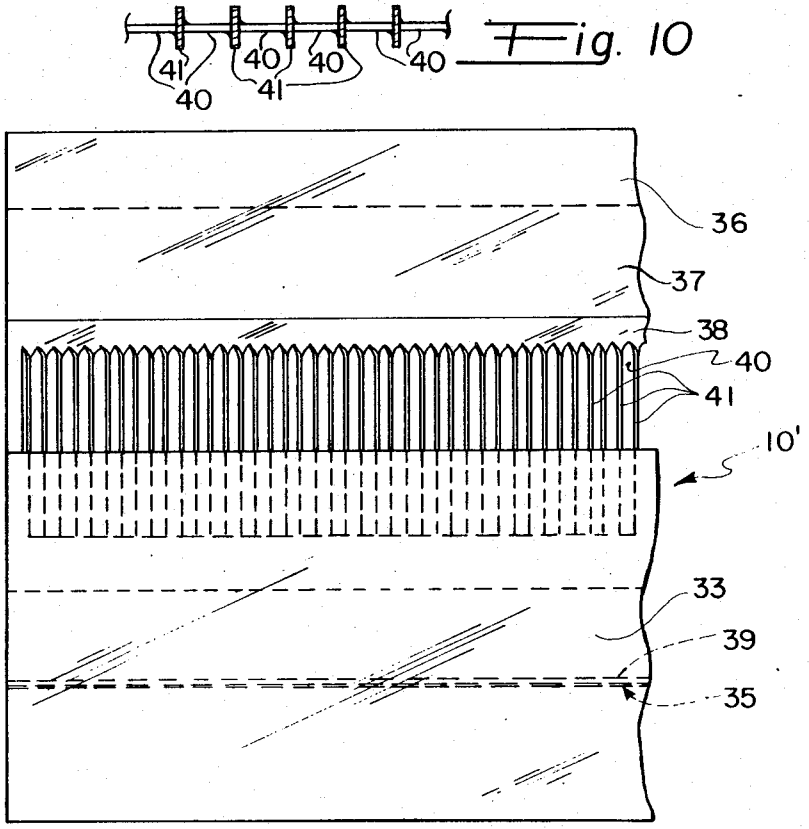
Fig. 9
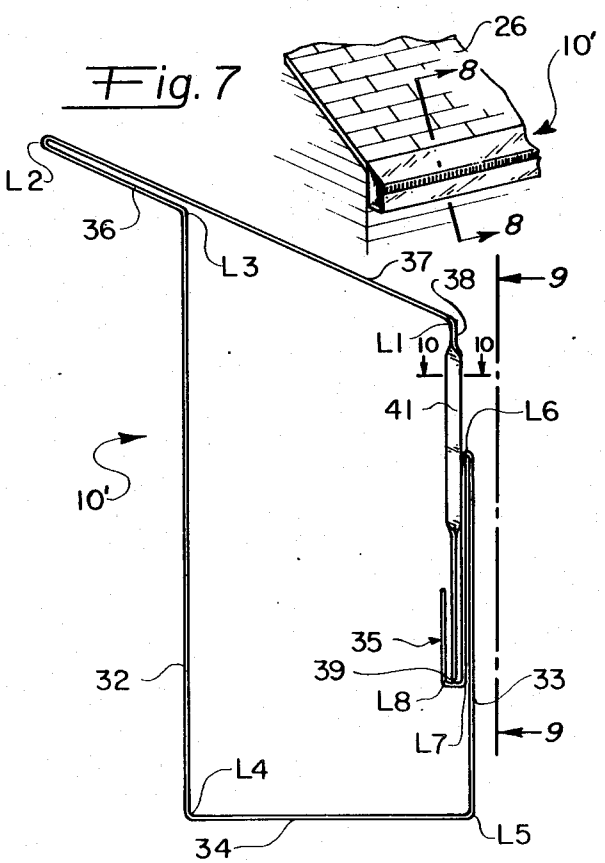
Fig. 8
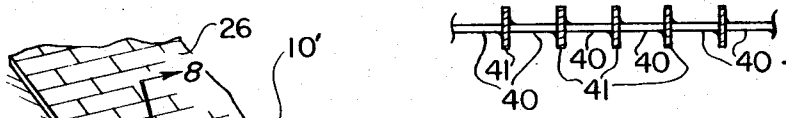
Fig. 10
Fig. 7

GUTTER SYSTEM AND METHOD OF MANUFACTURE

CROSS REFERENCE TO RELATED APPLICATION

This application is a continuation-in-part of application Ser. No. 546,747, filed Oct. 28, 1983, now U.S. Pat. No. 4,590,716, the disclosure of which is incorporated herein in its entirety.

BACKGROUND OF THE INVENTION

The present invention relates generally to gutters set below and along the eaves of a house or other premises to catch and carry off rain water; and more particularly, to an inherently low-cost, durable and architecturally-pleasing gutter that drains off the rain water by capillary action, such that leaves, twigs or foreign matter will not enter into and clog the gutter, together with a unique method for economical manufacture thereof.

The solutions heretofore resorted to by the prior researchers may be represented by the following U.S. and foreign patents.

| | Patent Number |
|---|---|
| United States Patents | |
| Inventor(s) | |
| Smith | 84,442 |
| Clark | 456,646 |
| Fisk | 493,697 |
| Keller | 520,993 |
| Van Horn | 546,042 |
| Nye | 603,611 |
| Taylor | 749,338 |
| Mills et al | 929,684 |
| Hensler | 939,838 |
| Koch | 946,919 |
| Kreutzberg | 956,372 |
| Clement | 1,498,351 |
| Beegle | 2,624,299 |
| Bartholomew | 2,669,950 |
| Heier | 2,873,700 |
| McLean | 3,053,393 |
| Olson | 3,295,264 |
| Nelems | 3,864,267 |
| Giordano | 3,909,905 |
| Franzmeier | 4,028,895 |
| LeFebvre | 4,199,121 |
| Hammond et al | 4,254,594 |
| Foreign Patents | |
| Country | |
| Sweden | 318,698 |
| Japan | 18,027 |
| Japan | 122,138 |
| PTC | 8,100,873 |

While these efforts by the prior researchers are interesting, and while the frequency and intensity of these efforts are mute testimony to the seriousness of the problem, nevertheless, the problem has remained and a totally satisfactory solution has heretofore not been available.

The gutters which are currently available on the market, and which are widely used by the homeowners, must be cleaned periodically. The cleaning should occur at least once a year and preferably twice a year, especially if the house is located on a wooded lot, to remove foreign matter from the gutters. The foreign matter may consist of leaves, twigs, acorns, insects, vermin, bird nests, and even pieces of deteriorating roof shingles. Cleaning the gutters is a time-consuming and laborious task; and besides, it is somewhat dangerous, depending upon the height and pitch of the roof and whether it is slippery. The gutters, for example, may be made of a relatively light-gauge vinyl-covered aluminum bent to have a generally circular or elliptical cross-section which is open at the top to allow the rain water to be collected in the gutters. Usually, wire screens or meshes are wedged or otherwise fitted within the gutters and across the top thereof so as to filter out the foreign matter from entering into the gutter. However, these wire screens are dislodged easily and become frayed. Additionally, the openings within the screens are relatively large to collect the water flowing off the roof. As a result, these wire screens are somewhat helpful, but unfortunately are not completely satisfactory.

SUMMARY OF THE INVENTION

Accordingly, it is an object of the present invention to alleviate the deficiencies and disadvantages of the prior art by providing an improved gutter system and a method of manufacture thereof.

It is another object of the present invention to provide an improved gutter that allows the water to flow off the roof and into the gutter by a capillary action, yet precludes leaves, twigs, decaying vegetation, acorns, insects, small birds, vermin, broken off pieces of deteriorating shingles, or other foreign matter from entering into the gutter, thereby preventing the gutter from becoming clogged, and thereby providing a substantially maintenance-free gutter system for the roof of a home or other structure.

It is yet another object of the present invention to provide an improved gutter which is relatively easy to install, durable, and is substantially maintenance free.

It is yet still another object of the present invention to provide an improved gutter which has a substantially box-like cross-section and which, when installed, is sufficiently rigid to resist the tendency of snow deposited on the roof (or ice formed on the roof) from pulling the gutter away from the roof structure.

It is a still further object of the present invention to make the improved gutter from a single piece of sheet metal, which is suitably punched, formed and bent to the desired configuration.

In accordance with the teachings of the present invention, a preferred embodiment is herein illustrated and described, constituting an improvement in the gutter system for the roof structure of a building. The improved gutter is formed of a substantially single folded sheet, preferably of sheet metal, and includes first and second side walls and a bottom wall therebetween. The first side wall is disposed substantially adjacent to the building and constitutes an inner face of the gutter. The second side wall is spaced from the first side wall and constitutes an outer face of the gutter. The second side wall has an integral portion bent to form a substantially U-shaped trough. The trough is disposed within the gutter and in relatively close proximity to the second side wall, inwardly thereof. The first side wall has an integral portion bent upwardly and obliquely therefrom and back upon itself to form a double-thickness tongue, which conforms substantially to the pitch of the roof; and means are provided for fastening the tongue to the roof. The tongue has an integral portion extending away from the roof and forming substantially an inclined top wall of the gutter. The top wall is spaced from the second side wall and has an integral portion bent downwardly therefrom substantially parallel to the second side wall, disposed inwardly of the second side wall and in relatively close proximity thereto, and terminating in an end portion received within the trough. The downwardly-bent integral portion of the top wall further has a plurality of substantially-vertical spaced openings formed therein, thereby forming a plurality of spaced comb teeth disposed between the top wall and the second side wall. With this arrangement, debris will be washed off the roof and the top wall of the gutter, and the water will be directed by capillary action to pass through the openings between the comb teeth and into the gutter.

In accordance with the further teachings of the present invention, the inclined top wall of the gutter is textured to improve the flow of rain water into the gutter. Additionally, the openings between the comb teeth are sufficiently narrow to prevent birds, vermin or small animals from entering into the gutter. Additionally, the first and second side walls are substantially vertical and parallel to each other; the bottom wall is substantially horizontal; and the top wall substantially follows the pitch of the roof. In a preferred embodiment, the comb teeth are bent substantially at right angles to the plane of the downwardly bent integral portion of the top wall.

In another aspect, the present invention constitutes a gutter for the pitched roof of a building, wherein the gutter has a substantially box-like structure including first and second substantially-parallel vertical side walls, a bottom wall therebetween, and a top wall inclined downwardly relative to the bottom wall and substantially following the pitch of the roof. One of the side walls constitutes an outer face of the gutter and includes a plurality of slotted openings formed therein substantially directly below the top wall of the gutter. As a result, debris will be washed off the roof and the top wall of the gutter, and the rain water will be directed by capillary action to pass through the slotted openings into the gutter.

In yet another aspect, the present invention constitutes, in a gutter system for the roof of the building structure, the combination of a top wall means and a substantially planar outer face, the outer face having a plurality of substantially vertically-oriented slotted openings formed therein substantially below the top wall means. The openings are separated by comb teeth, and the comb teeth are bent substantially at right angles to the plane of the outer face of the gutter. With this structure, the debris will be washed off the roof and the top wall means of the gutter, and the rain water will be directed by capillary action to pass through the openings and between the comb teeth and into the gutter. By the same token, however, the openings between the teeth are sufficiently narrow to preclude foreign matter from entering into the gutter.

In accordance with the still further teachings of the present invention, there is herein illustrated and described, an improved method for making a gutter for the roof structure of a building. The improved method includes the steps of providing a substantially flat piece of sheet material having a length and a width, and further having substantially parallel longitudinal edges. A plurality of openings are formed in the sheet. These openings are substantially parallel to each other and extend substantially in a band across the length of the sheet. The band is spaced inwardly from one of the longitudinal edges of the sheet and is substantially parallel thereto. The sheet is bent sequentially along a series of lines which are spaced from one another and are substantially parallel to each other and to the band of openings, thereby forming a substantially box-like enclosed structure. This enclosed structure includes substantially parallel side walls, a bottom wall therebetween, and an inclined top wall. One of the side walls is on the exterior of the gutter, when the gutter is mounted on the roof; and the band of openings is disposed on the exterior of the gutter substantially between the top wall and the one side wall.

In accordance with the yet still further teachings of the present invention, the openings are substantially slotted; and the material between the openings is bent substantially at right angles to the plane of the sheet, thereby forming a plurality of comb teeth. Preferably, the method includes the further step of forming a double-thickness tongue extending obliquely from the other (or inner) side wall and substantially forming a continuation of the inclined top wall. The preferred method includes the further step of bending the one side wall inwardly of the gutter to form a substantially U-shaped trough within the gutter, wherein the one longitudinal edge of the sheet is received within the trough.

In a yet still further aspect, the present invention constitutes an improved method for making a gutter for the roof structure of a building, wherein a sheet of material having a length and a width and further having at least one longitudinal edge is formed with a plurality of slotted openings therein. The openings are substantially parallel to each other and are separated by respective portions of the sheet metal. Additionally, the openings extend substantially in a band across the length of the sheet, and the band is spaced inwardly from the one longitudinal edge of the sheet and is substantially parallel thereto. The respective portions of the sheet between the slotted openings are bent substantially at right angles to the sheet, thereby forming a respective plurality of comb teeth interspersed between the slotted openings. The sheet is further bent to form substantially an enclosed gutter having a top wall means, such that the band of slotted openings and comb teeth is arranged substantially in a vertical plane on the exterior of the gutter and below the top wall means thereof.

Again, and viewed from a yet still further aspect, the present invention provides an improved gutter system for the migration of water, wherein a plurality of vertically downwardly depending spaced teeth extend from an edge of a roof at an oblique angle thereto. These teeth have a substantially uniform dimension and further have substantially constant cross-sections. A conduit means substantially surrounds a vertically depending portion of the teeth and includes a longitudinal slit which substantially straddles and encompasses the teeth with a relatively close fit therebetween.

With this structure, the spaces between adjacent teeth provide a capillary means of egress for the rain water from the roof into the conduit, and the debris washes off the roof and is precluded from entering into the conduit.

These and other objects of the present invention will become apparent from a reading of the following specification, taken in conjunction with the enclosed drawings.

BRIEF DESCRIPTION OF THE DRAWINGS

FIG. 7 is a perspective view of a second embodiment of the improved gutter of the present invention, showing its installation on a roof.

FIG. 8 is a cross-sectional view, taken along the lines 8—8 of FIG. 7 and drawn to an enlarged scale, and showing how the improved gutter is formed from a single sheet of material into a substantially box-like configuration, wherein the comb teeth are disposed between the inclined top wall and a side wall, the latter constituting the outer face of the gutter.

FIG. 9 is a front elevational view thereof, taken along the lines 9—9 of FIG. 8, and showing the band of comb teeth for diverting the rain water into the gutter by a capillary action.

FIG. 10 is a detail section view, taken across the lines 10—10 of FIG. 8 and drawn to an enlarged scale, and showing the openings between the right-angularly bent comb teeth.

GENERAL DESCRIPTION OF THE PREFERRED EMBODIMENTS

Figure 1:
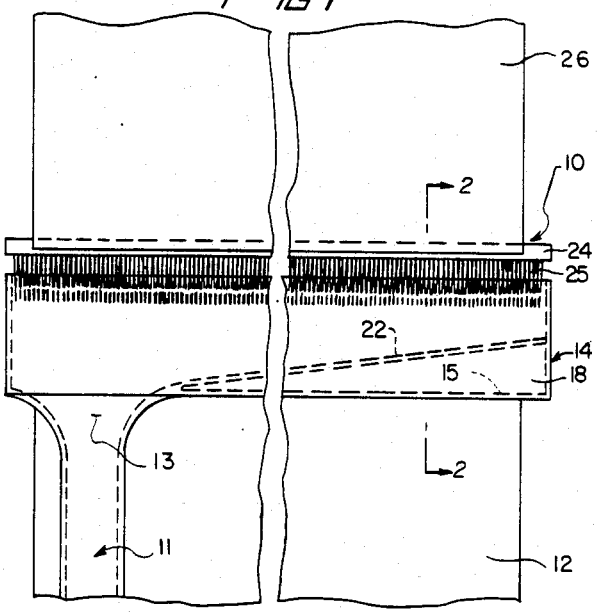
FIG. 1 is a front elevational view of one embodiment of the improved gutter of the present invention, showing its installation on the roof structure of a building (a support bracket for the gutter being omitted for ease of illustration).
Figure 2:
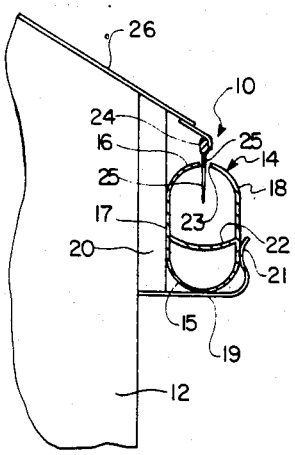
FIG. 2 is a cross-sectional view, taken along the lines 2—2 of FIG. 1, and showing the comb-like teeth received through a longitudinal slot in the top wall of the trough portion of the gutter.
Figure 3:
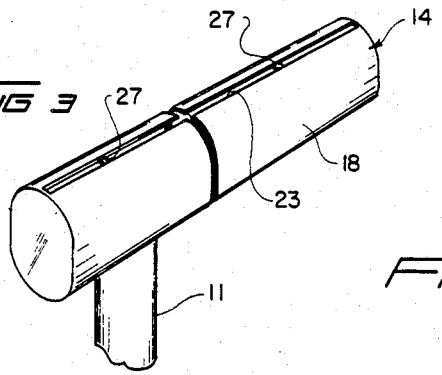
FIG. 3 is a perspective view of the trough portion of the gutter, disassembled from the roof.

With reference to FIGS. 1–6, a first embodiment of the gutter 10 of the present invention is illustrated. The gutter 10 includes a downspout 11 suitably fastened to the side of a building 12. The topmost portion of the downspout includes a flared portion 13 (as shown more clearly in FIG. 1) which communicates the downspout with a trough or conduit 14. The conduit 14 includes a bottom wall 15, a top wall 16, and respective side walls 17 and 18 formed to define an enclosed interior. In cross-section, the conduit may be of any suitable configuration, such as square, rectangular, oval, circular or the like, but in a preferred form (as shown more clearly in FIG. 2) it is ovaloid so that the top and bottom walls are substantially curved. The conduit is supported on a bracket 19, which is secured to a support plate or fascia 20 of the roof structure; and the conduit nests between the fascia 20 and an upstanding resilient lip 21 formed integrally with the bracket. Additionally, the curved top wall inhibits the formation of ice on the conduit which would otherwise tend to pull the conduit away from the fascia. Moreover, the interior of the conduit is provided with a sloped inner wall 22 which is canted downwardly toward the flared portion of the downspout (as shown more clearly in FIG. 1) thereby tending to increase the flow of water from the conduit towards the downspout.

In accordance with the teachings of the present invention, the top wall of the conduit 14 is formed with a relatively-narrow longitudinal slot 23, and a comb bar 24 having a plurality of substantially vertically-oriented comb teeth 25 is disposed within the slot with a relatively close fit therebetween. With this arrangement, the rain water will flow off the roof 26 and through the spaces between the comb teeth and into the conduit by a capillary action, while the debris and foreign matter will wash off the roof, thereby preventing the conduit from becoming clogged.

The molecules of various liquids, such as water, have an inherent physical attraction (not only for each other) but also for various surfaces along side of which and through which the water is directed. This molecular attraction is called capillary action. The present invention takes advantage of this capillary action of water to divert the water off the roof; and as a result, the water runs along side of and past the comb teeth and into the conduit. As the water washes off the roof, the water literally does a "vertical bend" and flows into the conduit of the improved gutter system of the present invention, rather than washing off the roof and onto the adjacent ground along with the leaves, twigs and other debris.

Preferably, the spacing between the comb teeth should be relatively narrow, thereby providing additional total surface area for the rain water to follow. By the same token, the spacing between the comb teeth 25 and the longitudinal slot 23 in the conduit is sufficiently narrow to preclude the leaves, twigs, debris, vermin, large insects or the like from entering into the conduit, thereby preventing the conduit from becoming clogged.

The conduit may be made of a relatively light-gauge sheet metal formed to the desired cross-sectional configuration, or out of a suitably molded plastic material. If the material of the conduit has an inherent resiliency, a plurality of spacers 27 may be employed (as shown more clearly in FIG. 3) to prevent the longitudinal slot 23 from closing and to assure that the slot has a substantially uniform width throughout its length.

The downwardly-extending comb teeth 25, which extend through the slot 23 and into the conduit 14 are preferably formed uniformly. These teeth 25 have respective upper portions of substantially rectangular cross-section, and the upper portions taper to respective points (as shown more clearly in FIG. 4). In addition, the comb teeth may have a textured surface to increase the capillary attraction of the rain water flowing thereon.

Figure 4:
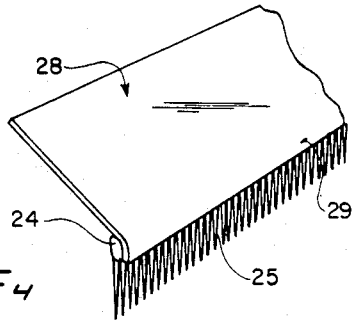
FIG. 4 is a perspective view of the comb teeth portion of the gutter.

With reference again to FIG. 2, and with further reference to FIG. 4, a comb support plate 28 has a downwardly-curved lip portion 29 within which the comb bar 24 is nested and suitably secured.

Figure 5:
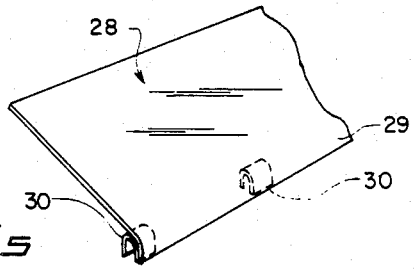
FIG. 5 is a perspective view of the support plate for the comb teeth, the plate having a plurality of spaced apart clips for receiving a bar of the comb teeth (not shown).

With reference to FIG. 5, a plurality of downwardly-depending, spaced-apart, U-shaped resilient clips 30 are secured within the downwardly-curved lip 29 of the support plate 28. These clips 30 receive and frictionally retain the comb bar 24.

Figure 6:
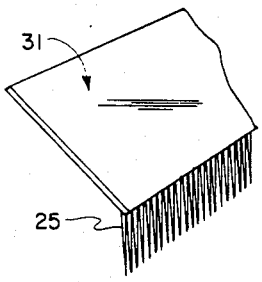
FIG. 6 is a perspective view of an alternate embodiment, wherein the comb teeth are formed integrally with a lowermost shingle for the roof.

With reference to FIG. 6, a lowermost shingle 31 may be provided with integrally-formed downwardly-projecting comb teeth 25. When the shingle 31 is secured to the lowermost edge of the pitched roof, the comb teeth 25 will extend through the longitudinal slot in the conduit.

In use and operation, the comb teeth 25 depend from the roof in substantially a vertical plane and cooperate with the shingles, comb support plate and lip 29 to take advantage of the capillary attraction of water or other liquid, thereby allowing the liquid to migrate down the comb teeth and through the slot into the conduit for quick removal by the downspout.

With reference to FIGS. 7–16, a second embodiment of the present invention is illustrated, wherein the gutter 10' secured to the roof 26 (as shown in FIG. 7) is formed preferably of a single folded sheet of material, such as light-gauge sheet metal (as shown more clearly in FIG. 8). The gutter 10' preferably is substantially box-like, having a substantially rectangular cross-sectional configuration, and includes first and second side walls 32 and 33, respectively, and a bottom wall 34 therebetween. Preferably, the side walls are substantially vertical and parallel to each other, and the bottom wall is substantially horizontal. The first side wall 32 is substantially adjacent to the building (more particularly to the fascia 20) and constitutes an inner face of the gutter. The second side wall 33 is spaced from the first side wall and constitutes an outer face of the gutter.

With particular reference to FIG. 8, the second side wall 33 of the gutter 10' has an integral portion bent inwardly therefrom to form a substantially U-shaped conduit or trough 35. This trough 35 is disposed within the gutter and in relatively close proximity to the second side wall inwardly thereof. The first side wall 32 has an integral portion bent upwardly and obliquely therefrom and then back upon itself to form a double-layer (or double thickness) tongue 36 by means of which the gutter 10' may be secured to the roof (as hereinafter described). The tongue 36 has an integral (single thickness) portion extending away from the roof and forming a top wall 37 of the gutter. This top wall 37 extends away from the roof and is inclined, relative to the bottom wall of the gutter, to substantially follow the pitch of the roof. Moreover, the top wall 37 is spaced vertically from the second side wall 33 and has an integral portion 38 bent downwardly therefrom. This downwardly-bent portion 38 is substantially parallel to the second side wall 33, is disposed inwardly therefrom and in close proximity thereto, and terminates in an end portion 39 received within the U-shaped trough 35 inwardly of the second side wall.

With reference again to FIG. 8, and with further reference to FIGS. 9 and 10, a plurality of substantially uniformly-spaced slotted openings 40 are formed in the downwardly-bent portion 38. Preferably, the width of the slotted openings 40 is substantially uniform, and the material between the slotted openings 40 is bent substantially at right angles to the plane of the portion 38 to form a respective plurality of comb teeth 41 interspersed substantially uniformly between the respective slotted openings. These comb teeth 41 extend substantially in a horizontal band (as shown more clearly in FIG. 9) and are disposed vertically between the top wall 37 and the second side wall 33 of the gutter 10', and have respective lower portions lodged against the inner surface of the second side wall (as shown more clearly in FIG. 8). The openings 40 between the comb teeth 41 are relatively narrow; and conversely, the comb teeth 41 are relatively close together, which facilitates the flow of rain water into the trough by capillary action.

The gutter 10' may be constructed in relatively long sections of any desired length [as for example, a length of eight (8) feet]; and the sections may be suitably fitted together, endwise, to form a continuation thereof. Moreover, once assembled, the U-shaped trough 35 at each end of a respective longitudinal section may be crimped to retain the end portion 39 therein; or in lieu thereof, a transverse "pop" rivet may be installed, thereby improving the mechanical rigidity and preventing the gutter 10' from "opening" or becoming somewhat distorted.

Figure 12:
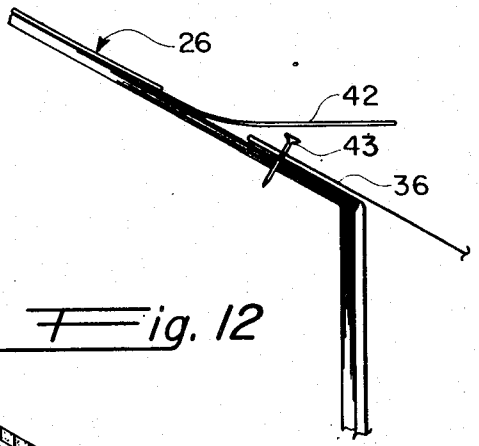
FIG. 12 is a detailed cross-sectional view, showing how the integral oblique tongue on the gutter is secured to the roof structure, after lifting up the lowermost shingle on the roof.
Figure 13:
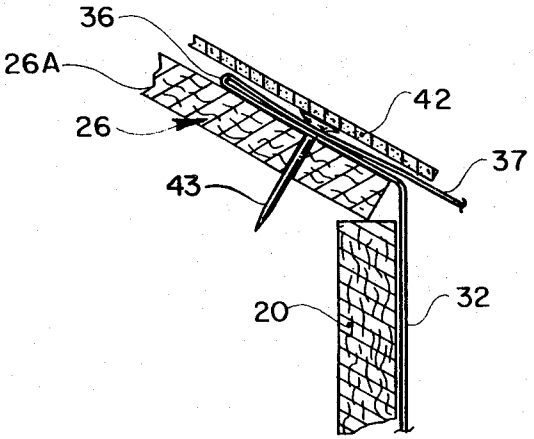
FIG. 13 is an enlarged view of a portion of FIG. 12, showing the integral oblique tongue secured to the plywood sheathing of the roof beneath the lowermost shingle, and further showing the inner side wall of the gutter substantially flush against, and supported by, the vertically-oriented fascia plate of the roof structure.
Figure 11:
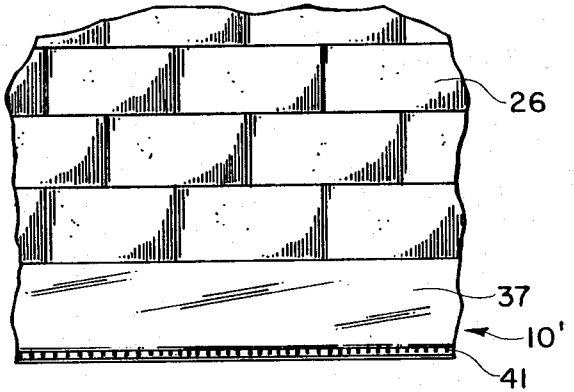
FIG. 11 is a top plan view of the improved gutter of the present invention, as installed on the roof structure.

With reference to FIGS. 12 and 13, the lowermost shingle 42 may be lifted up (as shown more clearly in FIG. 12) and the tongue 36 of the gutter 10' may be secured by a plurality of nails 43 (or other suitable means) to the plywood sheathing 26A of the roof 26 (as shown in FIG. 13).

Figure 14:
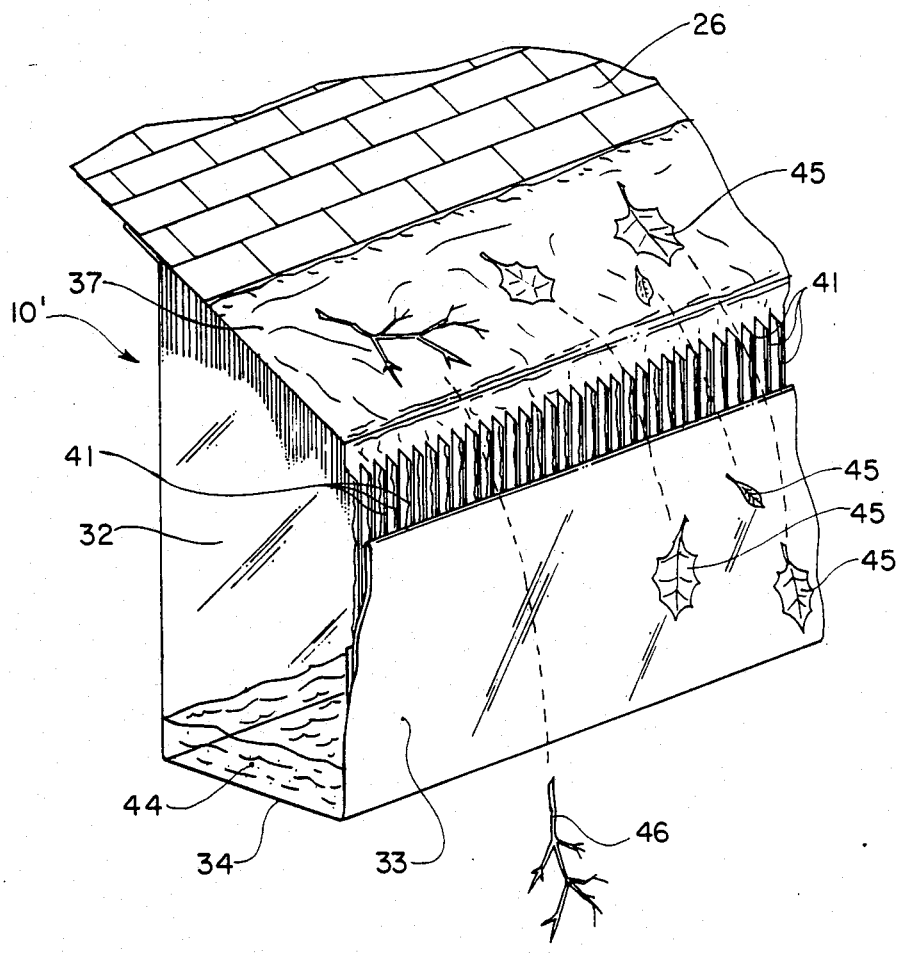
FIG. 14 is a perspective view of a cut-away portion of the improved gutter of the present invention, as installed on the roof, and showing the leaves, twigs and debris being washed off the roof and the inclined top wall of the gutter, as the rain water is diverted by a capillary action through the slotted openings between the vertical comb teeth formed on the exterior of the gutter and into the trough or conduit of the gutter for collection and flow through a conventional drain pipe or downspout (not shown).
Figure 15:
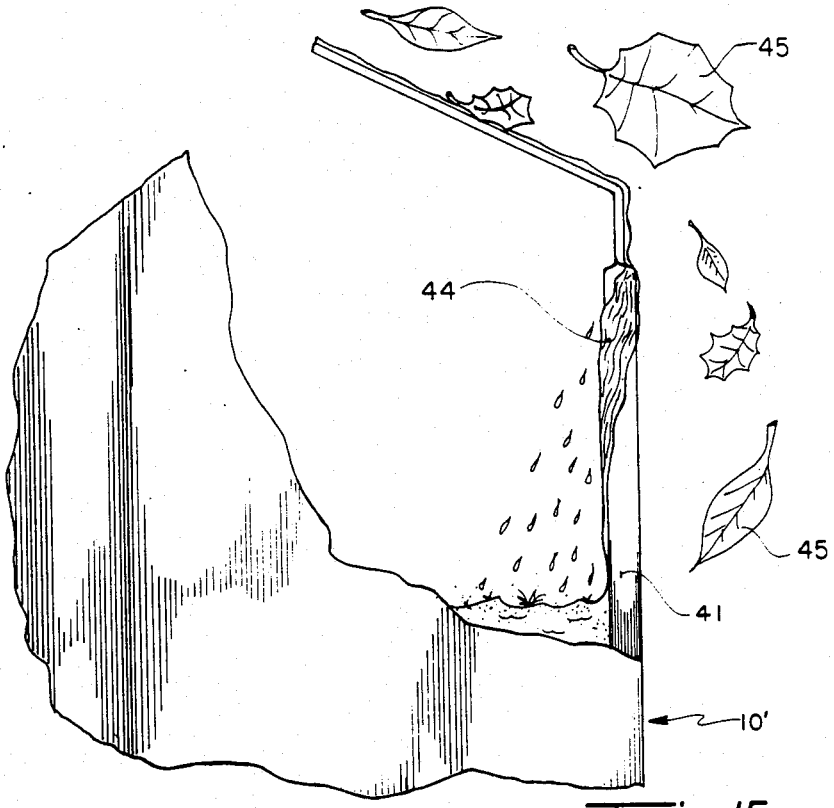
FIG. 15 is an end view thereof, looking into the gutter, and showing the rain water flowing off the roof and through the openings between the comb teeth and into the gutter by a capillary action.
Figure 16:
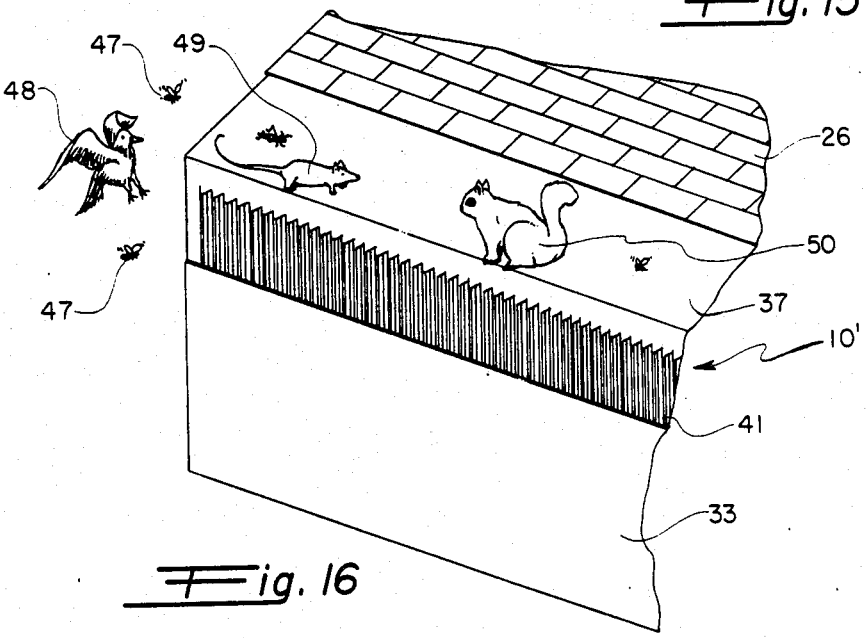
FIG. 16 is a further perspective view of the improved gutter installed on the roof, showing how the spacings between the comb teeth are sufficiently small to prevent vermin, small animals, birds, or large insects from entering into and nesting within the gutter.
Figure 17:
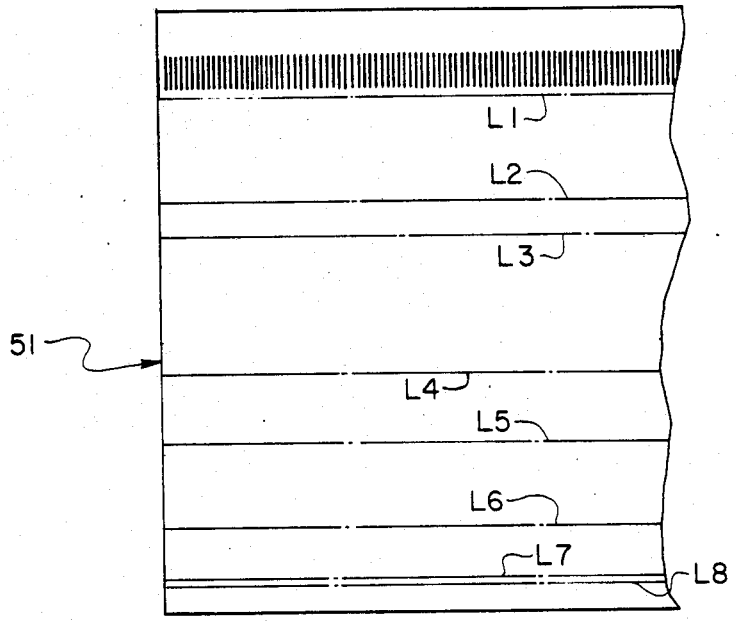
FIG. 17 is a top plan view of a portion of the substantially-planar single sheet from which the improved gutter of FIGS. 7–16 is made, showing the horizontal band of comb teeth interspersed between the vertically-slotted openings in the sheet, the band being spaced from a longitudinal side edge of the sheet and substantially parallel thereto, and further showing (in broken lines) the parallel lines around which the sheet is bent progressively to form the gutter into a substantially box-like configuration (as shown in FIG. 8).
Figure 18:
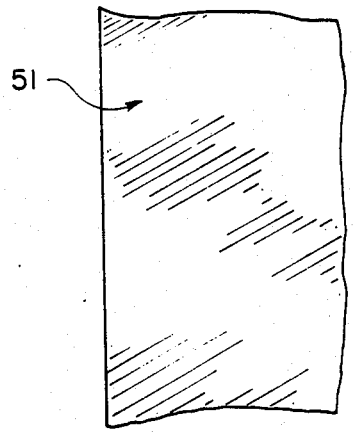
FIGS. 18–20 show, sequentially, how the sheet is punched to form the plurality of slotted openings (FIG. 19), and how the portions of the sheet between the openings are then bent substantially at right angles to the plane of the sheet to form the plurality of comb teeth between the respective slotted openings (FIG. 20).

With reference to FIGS. 14–16, the practical advantages and features of the present invention will become readily apparent. During a rainstorm, the water will flow over the roof 26 and over the inclined top wall 37 and, instead of washing directly off the roof and onto the ground, will "bend" vertically (as shown more clearly in FIG. 15) and by capillary attraction will follow the comb teeth 41 and flow through the slotted openings 40 between the respective teeth for collection, as at 44, within the conduit formed by the gutter 10' for removal through the conventional downspouts. By the same token, however, the leaves 45, twigs 46 and other debris and foreign matter will wash off the roof (as shown more clearly in FIGS. 14 and 15) and will be precluded from entering into the gutter 10'.

Moreover, the lateral or transverse spacing of the slotted openings 40 is relatively narrow, and yet the right-angularly bent comb teeth 41 are relatively rigid, so that large insects 47, birds 48, vermin 49 or small animals, such as squirrels 50, are prevented from entering into the gutter 10' and nesting therein.

As as result, the gutters will not become clogged; the annoying, time-consuming and somewhat hazardous cleaning of the gutters is obviated; and the maintenance of the gutters is substantially reduced if not eliminated altogether. When installed, the gutters are rigid and durable, substantially "maintenance free", and relatively unaffected by the formation of snow or ice on the roof. The gutters are neat and trim, asthetically pleasing, and readily blend into the architecture of the house or other structure. Moreover, the gutters are economical to manufacture and easy to install.

With reference to FIGS. 17–20, the preferred method for making the improved gutter 10' is illustrated. Preferably, the gutter 10' is made from a single substantially-flat sheet 51 of a suitable material, which will accommodate punching, crimping and bending operations. Thus, for example, the sheet 51 may be made of a relatively light-gauge aluminum, galvanized steel, or other sheet metal. If desired, a suitable plastic sheet may be used, and the bending of the plastic sheet may be accompanied by the application of heat.

Figure 19:
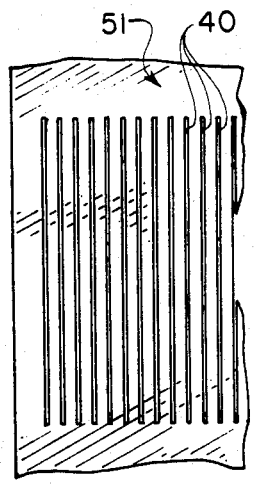
Figure 20:
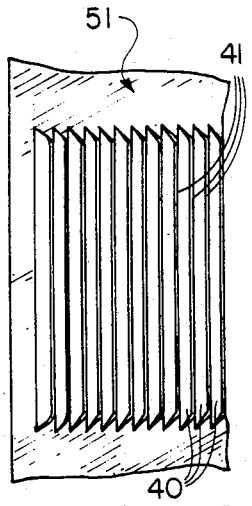

The sheet 51 is punched, as shown more clearly in FIG. 19, to form the plurality of parallel relatively-narrow slotted openings 40. Thereafter, as shown in FIG. 20, the material between the slotted openings 40 is bent or twisted substantially at right angles thereto to form the respective plurality of comb teeth 41. The sheet 51 may be fed into a progressive blanking and forming die in a punch press, so that the band of comb teeth is formed quickly for relatively low-cost manufacture. Thereafter, the sheet 51 is bent progressively or sequentially along the lines designated as L1–L7 in FIG. 17 to form the desired box-like configuration of FIG. 8, wherein the "corners" thereof are designated L1–L7, respectively. The particular sequence of bends may be reversed or rearranged, if desired; and it will be appreciated that in the final configuration, the longitudinal edges of the formed and bent sheet (constituting the terminal end portions of the sheet) substantially overlap one another. Also, a suitable coating may be applied for weather resistance and appearance; for example, the gutter 10' may be made from a vinyl coated aluminum.

Preferably, the sheet 51 is provided with a textured or embossed surface, which improves the appearance of the gutter. Moreover, the textured surface on the inclined top wall will be "wetted" more readily for improving the flow of rain water into the gutter.

Accordingly, the improved gutter of the present invention is not only substantially maintenance free, rugged and reliable, and architecturally pleasing, it is also economical to manufacture and easy to install.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. In a gutter system for the pitched roof structure of a building, the improvement wherein the gutter is formed of a substantially single folded sheet and includes first and second side walls and a bottom wall therebetween, the first side wall being disposed substantially adjacent to the building and constituting an inner face of the gutter, the second side wall being space from the first side wall and constituting an outerface of the gutter, the second side wall having an integral portion bent to form a substantially U-shaped trough, the trough being disposed within the gutter and in relatively close proximity to the second side wall inwardly thereof, the first side wall having an integral portion bent upwardly and obliquely therefrom and back upon itself to form a double thickness tongue conforming substantially to the pitch of the roof, means for fastening the tongue to the roof, the tongue having an integral portion extending away from the roof and forming substantially an inclined top wall of the gutter, the top wall being spaced from the second side wall and having an integral portion bent downwardly therefrom substantially parallel to the second side wall, inwardly of the second side wall and in relatively close proximity thereto, and terminating in an end portion received within the trough, wherein the interior angle between the top wall and the downwardly bent integral portion of the top wall is substantially equal to 90° plus the pitch of the roof, the downardly-bent integral portion of the top wall further having a plurality of substantially-vertical spaced openings formed therein substantially directly below the top wall, wherein a plurality of spaced comb teeth are disposed between the top wall and the second side wall, said comb teeth being bent substantially at right angles to the plane of the downwardly bent integral portion of the top wall, whereby debris will be washed off the roof and the top wall of the gutter, and whereby water will be directed by capillary action to pass through the openings between the comb teeth and into the gutter.

2. The improvement of claim 1, wherein the inclined top wall of the gutter is textured to improve the flow of water into the gutter.

3. The improvement of claim 1, wherein the openings between the comb teeth are sufficiently narrow to prevent vermin from enetering into the gutter.

4. The improvement of claim 1, wherein the first and second side walls are substantially vertical and parallel to each other, wherein the bottom wall is substantially horizontal, and wherein the top wall substantially follows the pitch of the roof.

5. In a gutter system for the pitched roof structure of a building, the imrpovement wherein the gutter is formed of a substantially single folded sheet and includes first and second side walls and a bottom wall therebetween, the first and second side walls being substantially vertical and parallel to each other, the bottom wall being substantially horizontal, the first side wall being disposed substantially adjacent to the building and constituting an inner face of the gutter, the second side wall being spaced from the first side wall and constituting an outer faceof the gutter, the second side wall having an integral portion bent to form a substantially U-shaped trough, the trough being disposed within the gutter and in relatively close proximity to the second side wall inwardly thereof, the first side wall having an integral portion bent upwardly and obliquely therefrom and back upon itself to form a double thickness tongue conforming substantially to the pitch of the roof, means for fastening the tongue to the roof, the tongue having an integral portion extending away from the roof and forming substantially a top wall of the gutter, the top wall being textured and substantially following the pitch of the roof and having an integral portion spaced vertically from the second side wall and bent forwardly therefrom substantially parallel to the second sidewall, disposed inwardly of the second side wall and in relatively close proximity thereto, and terminating in an end portion received within the trough, wherein the interior angle between the top wall and the downwardly bent integral portion of the top wall is substantially equal to 90° plus the pitch of the roof, the downwardly-bent integral portion of the top wall further having a plurality of substantially-vertical spaced openings formed therein substantially directly below the top wall, thereby forming a plurality of spaced comb teeth disposed between the top wall and the second side wall, and the comb teeth being bent substantially at right angles to the plane of the downwardly-bent integral portion of the top wall, whereby debris will be washed off the roof and the top wall of the gutter, whereby water will be directed by capillary action to pass through the openings between the comb teeth and into the gutter, and wherein the openings between the comb teeth are sufficiently narrow to prevent vermin from entering into the gutter.

6. A gutter for the pitched roof of a building structure, comprising, in combination, a substantially box-like structure including first inner and second outer substantially-parallel vertical side walls, a bottom wall therebetween, and a top wall inclined downwardly and substantially following the pitch of the roof, said top wall being spaced from the second outer wall and having an integral portion bent substantially vertically downwardly therefrom, wherein the interior angle between the top wall and the downwardly bent portion is substantially equal to 90° plus the pitch of the roof, said integral portion being substantially parallel to and inwardly of the second outer wall, said itnegral portion having a plurality of vertical spaced comb teeth formed therein, said comb teeth being bent substantially at right angles to the plane of the integral portion such that a plurality of vertically-oriented slotted openings are formed therein substantially directly below the top wall, whereby debris will be washed off the roof and the top wall of the gutter, and whereby water will be directed by capillary action to pass through the slotted openings into the gutter.

7. In a gutter for the pitched roof of a building strucutre, the combination comprised of: a top wall means positioned on the roof, and a substantially-planar outer face positioned adjacent the top wall vertically thereof, wherein the interior angle between the top wall and the outer face is substantially equal to 90° plus the pitch of the roof, said outer face having a plurality of substantially vertically oriented slotted openings formed therein substantially directly below the top wall means, the openings defining comb teeth therebetween, said comb teeth being bent substantially at right angles to the plane of the outer face of the gutter, whereby debris will be washed off the roof and the top wall means of the gutter, and whereby water will be directed by capillary action to pass through the openings and between the comb teeth and into the gutter, and wherein the openings between the teeth are sufficiently narrow to preclude foreign matter from entering into the gutter.

8. In a gutter system for the removal of rain water from the pitch roof of a building, the combination of a conduit having a longitudinal opening formed therein substantially parallel to the builing roof, an inclined top wall following substantially the pitch of the roof and disposed above the conduit, a plurality of comb teeth carried by the top wall substantially directly below said top wall, wherein the interior angle between the plane of the top wall and the plane of the comb teeth is substantially equal to 90° plus the pitch of the roof, and said comb teeth extending through the longitudinal opening and into the conduit of the gutter with a relatively close fit therebetween, the comb teeth being substantially uniformly spaced and being bent at substantially right angles to the plane of the integral portion, and said comb teeth being separated from one another by relatively narrow openings, whereby debris will be washed off the roof and the inclined top wall, whreby the rain water will be directed by capillary action to pass through the openings between the comb teeth and into the conduit, wherein the openings between the teeth are sufficiently narrow to preclude foreign matter from entering into the gutter, and wherein the inclined top wall is textured to improve the flow of the rain water into the conduit.

9. A gutter system disposed at the edge of a pitched roof, comprising an elongated conduit having an enclosed bottom wall, top wall and side walls formed of a single sheet material, the single sheet having opposing terminal end portions which together form one of the side walls in an overlapping configuration, and one of the terminal end portions having formed therein a comb-like structure, a portion of which is disposed against an inside surface of the other of the terminal end portions of the sheet material vertically thereof, wherein the interior angle between the top wall and the comb-like structure is substantially equal to 90° plus the pitch of the roof, whereby the comb-like strucutre transmits water from said roof via capillary action into the interior of the conduit.

10. A gutter system according to claim 9, wherein the other of the terminal end portions is bent back upon itself to form a substantially U-shaped trough for receiving the one terminal end portion.

11. A gutter system according to claim 9 wherein the elongated conduit further includes a tongue portion extending from the top wall for attaching to the roof.

12. A gutter system according to claim 11, wherein the tongue portion comprises a portion of the sheet material which is bent back upon itself to provide a double thickness.

13. A gutter system disposed at the edge of a pitched roof, comprising an elongated conduit having an enclosed bottom wall, top wall and side wall formed of a single sheet material, the single sheet having opposing terminal end portions which together form on of the side walls in an overlapping configuration, one of the terminal end portions having formed therein a comb-like structure being bent substantially downwardly, a portion of which is disposed against an inside surface of the other of the terminal end portions of the sheet material, wherein the interior angle between the top wall and the comb-like structure is substantially equal to 90° plus the pitch of the roof, said comb-teeth being bent substantially at right angles to the plane of the comb-like structure, wherein openings are formed therebetween positioned substantially directly below the top wall, whereby the comb-like structure transmits water from the roof via capillary action into the interior of the conduit, the other of the terminal end portions being bent back upon itself to form a substantially U-shaped trough for receiving the one yerminal end portion, and a tongue portion extending from the top wall for attaching to the roof, the tongue portion comprising a portion of the sheet material which is bent back upon itself to provide a double thickness.

14. A gutter system disposed at the edge of a pitched roof, comprising an elongated conduit having an enclosed top wall, bottom wall and side walls formed of a single sheet material, opposing terminal end portions of the sheet material together forming one of the side walls in ah overlapping configuration, one of the terminal end portions having formed therein a teeth-like structure having parallel edges extending beyond the plane of said sheet material, vertically thereof, wherein the interior angle between the top wall and the teeth-like structure is substantially equal to 90° plus the pitch of the roof, and a portion of the teeth-like structure being disposed on an inside surface of the other of the terminal end portions, wherein the edges of the teeth-like structure rest against the inside surface and extend into the interior of the conduit.

15. In a rain gutter for a pitched roof of a building, the rain gutter being fabricated from a relatively-light gauge material, the combination of a downardly-inclined top wall substantially following the pitch of the roof, the top wall having an upper forward edge and further having an integral bent portion extending downwardly therefrom and disposed in a substantially vertical plane, such that the interior angle between the top wall and the integral bent portion is substantially equal to 90° plus the pitch of the roof, an outer side wall having an upper edge disposed below the upper foward edge of the top wall and further having an integral portion bent inwardly therefrom and extending downwardly within the gutter and terminating in an upwardly-opening substantially U-shaped trough disposed inwardly adjacent of the outer side wall of the gutter, the inegral bent poriton of the top wall having a downardly-extending end portion receive substantially closely within the U-shaped trough, thereby supporting the integral bent portion of the top wall, and thereby enhancing the structural integrity of the relatively-light gauge rain gutter, and the integral bewnt portion of the top wall further having an intermediate portion running substantially between the upper forward edge of the top wall and extending below the upper edge of the outer side wall, said intermediate portion of the integral bent portion of the top wall having a plurality of horizontally-extending vertically-disposed slotted openings formed therein substantially directly below the top wall, the slotted openings being separated by respective outwardly-bent comb teeth, and at least a portion of the comb teeth extending within the gutter below the upper edge of the outer side wall.

16. The rain gutter of claim 15, wherein the slotted openings are substantially rectangular in plan outline, and wherein the comb teeth are bent substantially at right angles to the plane of the intermediate bent portion.

* * * * *